US006930262B2

(12) United States Patent
Lee

(10) Patent No.: US 6,930,262 B2
(45) Date of Patent: Aug. 16, 2005

(54) SAFETY SWITCH BOX FOR SAW MACHINE

(76) Inventor: Wy Peron Lee, 11614 Sterling Ave., Ste. 103, Riverside, CA (US) 92503

( * ) Notice: Subject to any disclaimer, the term of this patent is extended or adjusted under 35 U.S.C. 154(b) by 102 days.

(21) Appl. No.: 10/609,502

(22) Filed: Jun. 30, 2003

(65) Prior Publication Data

US 2004/0262138 A1 Dec. 30, 2004

(51) Int. Cl.[7] ..... H01H 9/28

(52) U.S. Cl. ..... 200/43.17; 200/43.11; 200/43.22; 200/334

(58) Field of Search ..... 200/43.01, 43.11–43.18, 200/43.22, 329, 334, 339

(56) References Cited

U.S. PATENT DOCUMENTS 4,713,509 A * 12/1987 Chebowski ..... 200/318.1
4,879,438 A * 11/1989 Winchester ..... 200/61.85
5,161,679 A * 11/1992 Russo ..... 200/43.17
5,380,964 A * 1/1995 Easton et al. ..... 200/43.01
5,868,242 A * 2/1999 Hall et al. ..... 200/43.14

* cited by examiner

*Primary Examiner*—Richard K. Lee
(74) *Attorney, Agent, or Firm*—Raymond Y. Chan; David and Raymond

(57) ABSTRACT

A saw switch box includes a supporting base resting on a switch platform, a switch shelter pivotally connected to the supporting base to define a sheltering cavity between the switch shelter and the supporting base for receiving a switch member, and a locking device for locking the switch shelter on the supporting base at the idle position. In which, at an operation position, the switch shelter is pivotally folded to a position that a contacting side of the switch shelter is adapted for contacting with the switch member to protectively shelter the switch member within the sheltering cavity in position while the saw machine is operating, and at the idle position, an operation side of the switch shelter is pressed to force the contacting side thereof for pivotally pressing the switch member downward to switch off the saw machine.

16 Claims, 3 Drawing Sheets

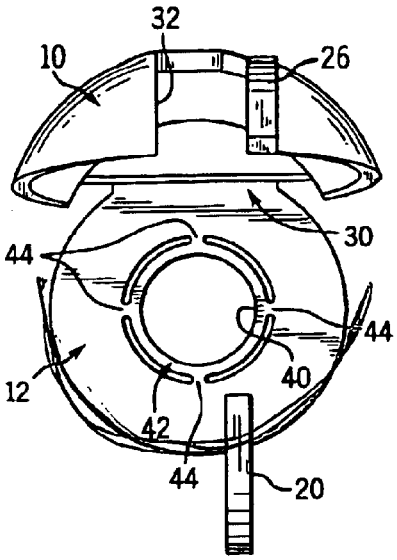
FIG. 3
FIG. 4
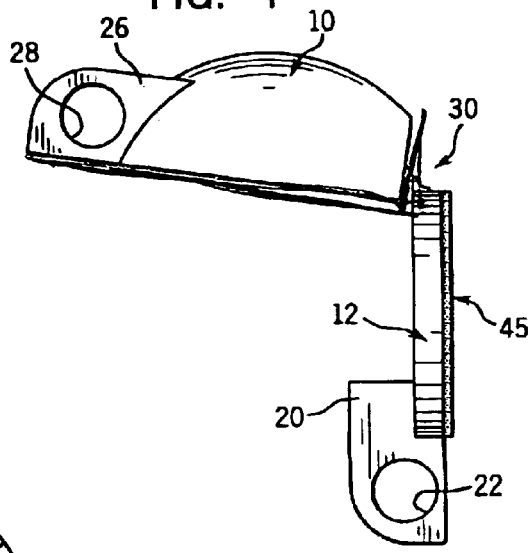
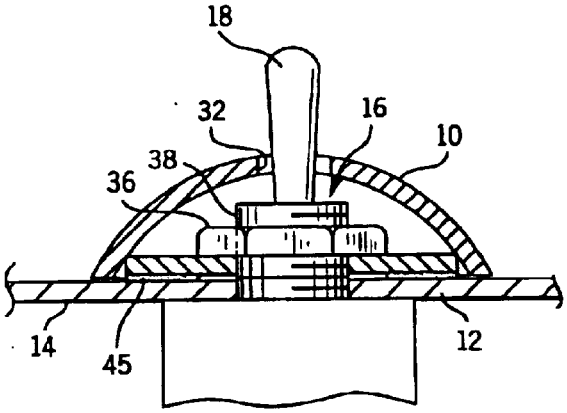
FIG. 5
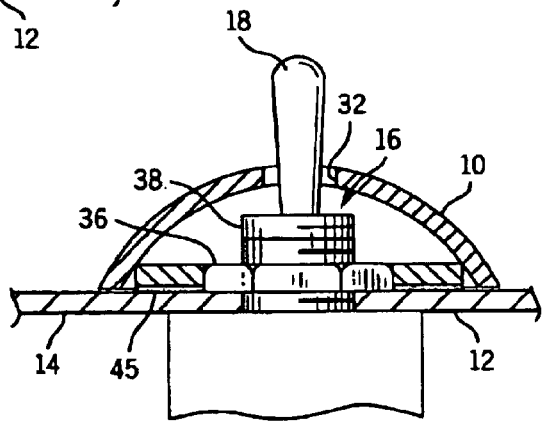
FIG. 6

SAFETY SWITCH BOX FOR SAW MACHINE

BACKGROUND OF THE PRESENT INVENTION

1. Field of Invention

The present invention relates to a saw machine, and more particularly to a safety switch box for the saw machine, which can incorporate with a control switch of the saw machine for locking up the control switch at an off position, so as to prevent the saw machine from being switched on accidentally.

2. Description of Related Arts

A saw machine generally comprises a power control, having a control switch, to electrically control the operation of the saw machine in an on and off manner. Accordingly, the saw machine usually employs a liquid coolant pumping to the saw blade and the work piece during cutting operation to reduce the accumulated heat and flush away sawdust. In other words, the user's hands may get wet during the cutting operation.

In order to prevent an electric shock when the user's hands are wet, a conventional push button cannot be used as the control switch of the power control. It is because the user must apply a pressing force on the push button to switch on the saw machine. Therefore, the user may get electric shock when the user's finger contacts with the push button. In addition, it is dangerous that the user may accidentally switch on or off the saw machine by pressing on the push button.

Accordingly, the saw machine usually employ with an elongated switch member as the control switch wherein the switch member is pivotally mounted on a control head of the power control in such a manner that the saw machine is switched on when the switch member is pivotally push upward and the saw machine is switched off when the switch member is pivotally push downward.

The advantage of such switch member is that the switching operation of the switch member is quick and simple. In order to prevent the electric shock, especially when the user's hands are wet during the cutting operation of the saw machine, the user is able to use an object, such as a tile, to force the switch member pivotally moved downward so as to stop the operation of the saw machine. It is a great convenience for the user to switch on and off the saw machine without touching the switch member. However, once the tile hits on the switch member, the switch member may be broken. Even though the switch member is replaceable, the user cannot switch off the saw machine simultaneously. It is extremely dangerous the user must unplug the main switch of the saw machine to stop the operation thereof when the switch member is broken and the user's hands are wet. In addition, the user may accidentally switch on or off the saw machine because of the easy switching operation of the switch member. In other words, a safety device is a must to prevent the unintentionally switching operation of the saw machine.

SUMMARY OF THE PRESENT INVENTION

A main object of the present invention is to provide a safety switch box for a saw machine, which can incorporate with a control switch of the saw machine for locking up the control switch at an off position, so as to prevent the saw machine from being switched on accidentally.

Another object of the present invention is to provide a safety switch box for a saw machine, wherein the control switch is normally received in the sheltering cavity of the safety switch box, so as to prevent the unintentionally switching operation of the saw machine.

Another object of the present invention is to provide a safety switch box for a saw machine, wherein the switching operation of the control switch is manipulated by the switch shelter such that the user does not need to contact with the control switch in order to switch off the saw machine, so as to prevent the electric shock especially when the user's hands are wet during the cutting operation of the saw machine.

Another object of the present invention is to provide a safety switch box for a saw machine, wherein the operation of the safety switch box is easy and simple that by pressing the switch shelter towards the control switch so as to switch off the saw machine.

Another object of the present invention is to provide a safety switch box for a saw machine, wherein the safety switch box is adapted to be installed into any kind of saw machine to incorporate with the control switch having a switch member.

Another object of the present invention is to provide a safety switch box for a saw machine, which does not require to alter the original structure of the control switch of the saw machine, so as to minimize the manufacturing cost of the saw machine incorporating with the control switch.

Accordingly, in order to accomplish the above objects, the present invention provides a safety switch box for a control switch of a saw machine which comprises a switch platform and a switch member pivotally extended on the switch platform to operate the saw machine in an on and off manner, wherein the safety switch box comprises:

a supporting base adapted for resting on the switch platform, wherein the supporting base has a through slot formed thereon for the switch member passing through;

a switch shelter, which has an outer operating side and an inner contacting side, pivotally connected to the supporting base to define a sheltering cavity between the switch shelter and the supporting base for receiving the switch member, wherein the switch shelter is capable of being pivotally folded between an idle position and an operation position; and means for locking the switch shelter on the supporting base at the idle position, wherein at the operation position, the switch shelter is pivotally folded to a position that the contacting side of the switch shelter is adapted for contacting with the switch member to protectively shelter the switch member within the sheltering cavity in position while the saw machine is operating, and at the idle position, the operation side of the switch shelter is pressed to force the contacting side thereof for pivotally pressing the switch member downward to switch off the saw machine.

These and other objectives, features, and advantages of the present invention will become apparent from the following detailed description, the accompanying drawings, and the appended claims.

BRIEF DESCRIPTION OF THE DRAWINGS

FIG. 3 is a sectional view of the safety switch box at an operation position according to the above preferred embodiment of the present invention.

FIG. 4 is a sectional view of the safety switch box at an idle position according to the above preferred embodiment of the present invention.

FIG. 5 is a perspective view of the safety switch box mounted on the saw machine according to the above preferred embodiment of the present invention, illustrating the switch shelter being pressed by a user's thumb to switch on the saw machine.

FIG. 6 is a perspective view of the safety switch box according to the above preferred embodiment of the present invention, illustrating the switch member being pushed upward.

DETAILED DESCRIPTION OF THE PREFERRED EMBODIMENT

Figure 1:
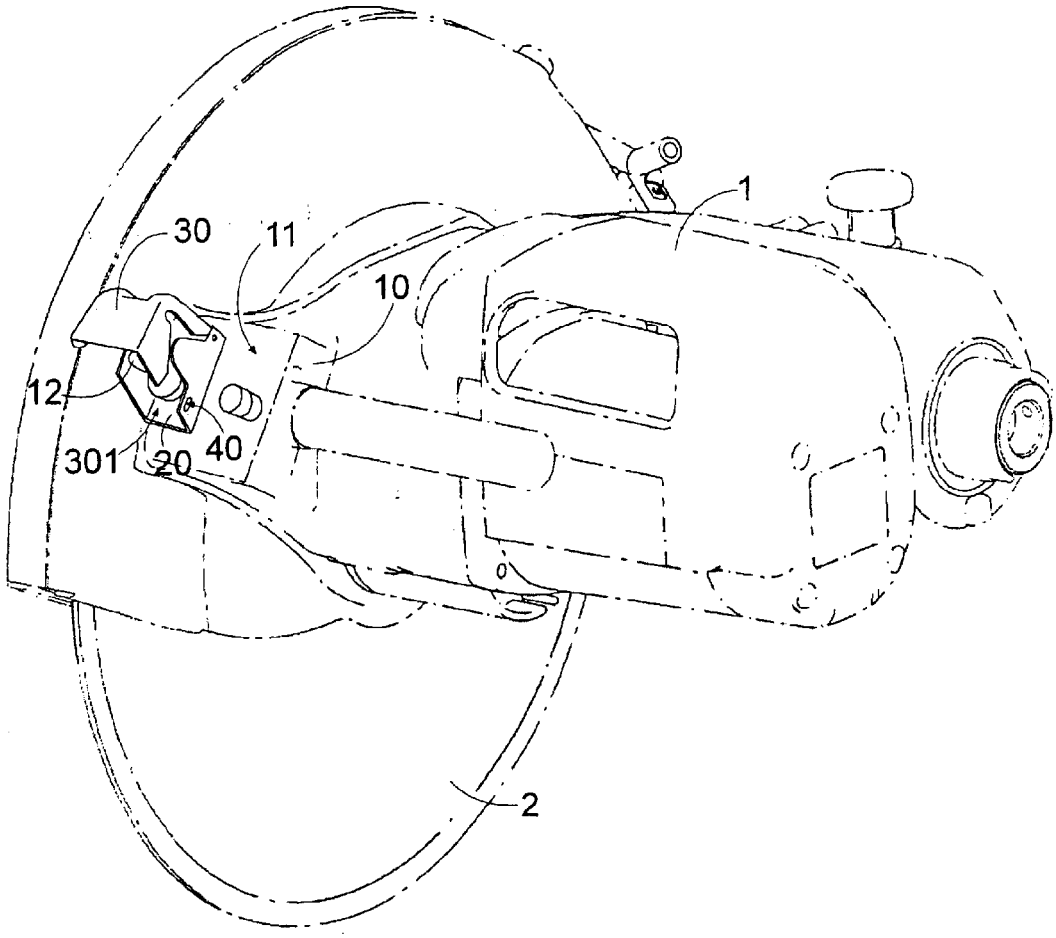
FIG. 1 is a perspective view of a safety switch box incorporating with a saw machine according to a preferred embodiment of the present invention.
Figure 2:
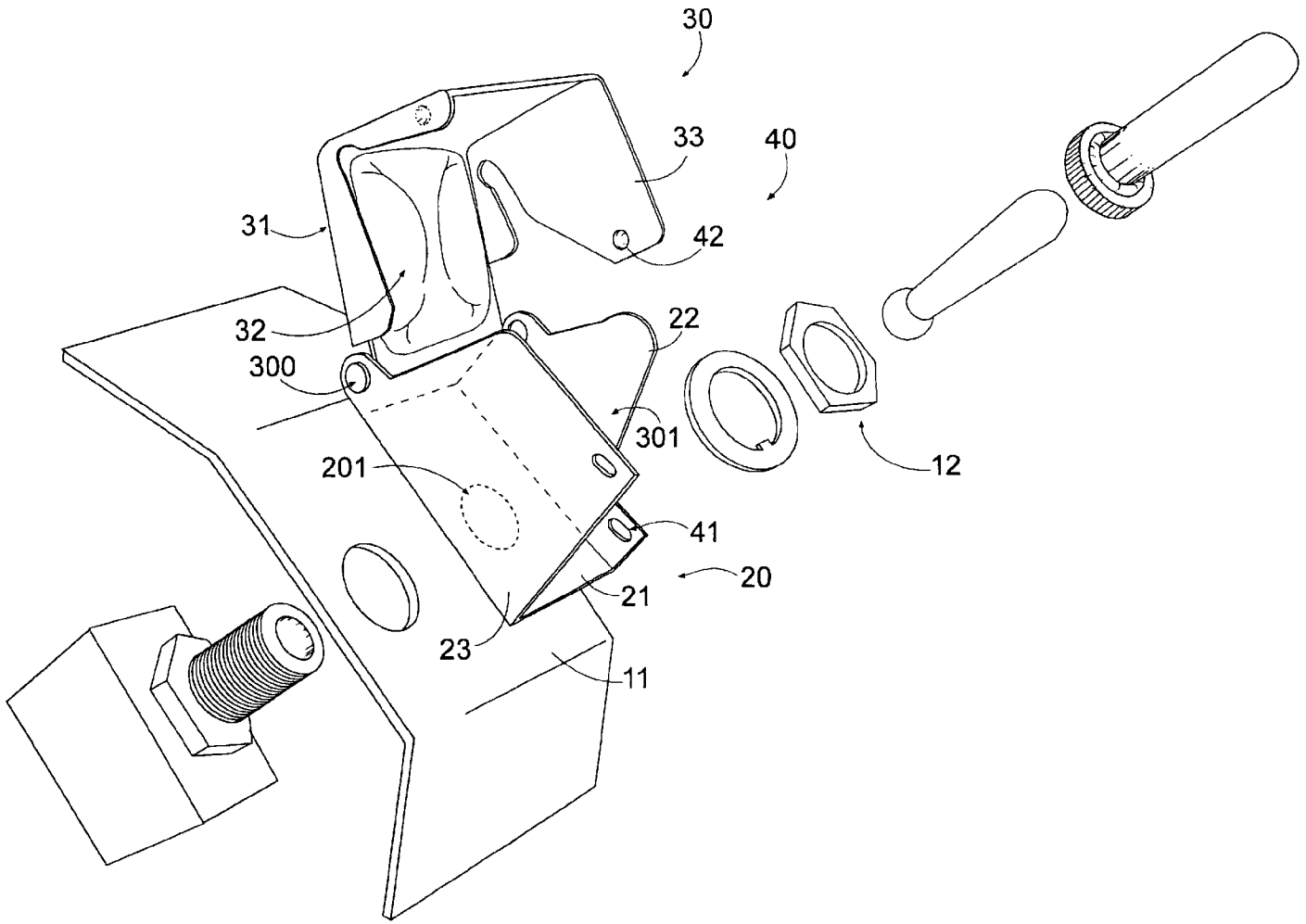
FIG. 2 is an exploded view of the safety switch box for the saw machine according to the above preferred embodiment of the present invention.

Referring to FIGS. 1 and 2 of the drawings, a safety switch box incorporating with a saw machine is illustrated, wherein the saw machine, such as a conventional saw machine, comprises a control switch 10 electrically connected with a motor 1 to a power source so as to drive a saw blade 2 to rotate. The control switch 10 generally comprises a switch platform 11 and a switch member 12 pivotally extended on the switch platform 11 to operate the motor 1 of the saw machine in an on and off manner.

The safety switch box comprises a supporting base 20 adapted for resting on the switch platform 11, wherein the supporting base 20 has a through slot 201 formed thereon for the switch member 12 passing through, and a switch shelter 30, which has an outer operating side 31 and an inner contacting side 32, pivotally connected to the supporting base 20 to define a sheltering cavity 301 between the switch shelter 30 and the supporting base 20 for receiving the switch member 12, wherein the switch shelter 30 is capable of being pivotally folded between an idle position and an operation position.

The safety switch box further comprises means 40 for locking the switch shelter 30 on the supporting base 20 at the idle position, wherein at the operation position as shown in FIG. 3, the switch shelter 30 is pivotally folded to a position that the contacting side 32 of the switch shelter 30 is adapted for contacting with the switch member 12 to protectively shelter the switch member 12 within the sheltering cavity 301 in position while the saw machine is operating, and at the idle position as shown in FIG. 4, the operation side 31 of the switch shelter 30 is pressed to force the contacting side 32 thereof for pivotally pressing the switch member 12 downward to switch off the saw machine.

According to the preferred embodiment, the supporting base 20, having a U-shaped cross section, further has a base platform 21 defining the through slot 201 thereon and first and second sidewalls 22, 23 upwardly extended from the base platform 21 to define the sheltering cavity 301 within the base platform 21, and the first and second sidewalls 22, 23. As shown in FIG. 1, the base platform 21 is rested on the switch platform 11 while the switch member 12 is passed through the base platform 21 through the through slot 201 to position between the first and second sidewalls 22, 23.

The switch shelter 30, having a L-shaped cross section, is pivotally connected to the supporting base 20 via a pivot joint 300 wherein the switch shelter 30 further has a side arm 33 downwardly extended from a peripheral edge to overlap with the first sidewall 22 of the supporting base 20.

The switch shelter 30 further has a thumb cavity 34 formed thereon to form the operating side 31 of the switch shelter 30 having a concave surface and the contacting side 32 of the switch shelter 30 having a corresponding convex surface. Accordingly, the thumb cavity 34 of the switch shelter 30 is shaped and sized for fittingly receiving a user's thumb to press on the operating side 31 of the switch shelter 30 so as to push the switch shelter 30 from the operation position to the idle position.

As shown in FIG. 3, the contacting side 32 of the switch shelter 30 has a slanted surface portion 321 arranged for contacting with the switch member 12 so as to substantially push the switch member 12 to switch on the saw machine. Accordingly, when the switch shelter 30 is pivotally folded towards the supporting base 20, the slanted surface portion 321 of the contacting side 32 of the switch shelter 30 is arranged to contact with the switch member 12 at the idle position. Therefore, when the operating side 31 of the switch shelter 30 is pressed downwardly, the slanted surface portion 321 of the switch shelter 30 substantially engages with the switch member 12 so as to push the switch member 12 to switch off the saw machine.

The locking means 40 has a locking groove 41 formed on the first sidewalls 22 of the supporting base 20 and at least a corresponding locking protrusion 42 formed on the side arm 33 to engage with the locking groove 41 so as to lock up the switch shelter 30 with the supporting base 20 at the idle position. Accordingly, a peripheral edge of the first sidewall 22 functions as a blocking edge 221 to block the locking protrusion 42 engaging with the locking groove 41 wherein when the switch shelter 30 is pivotally folded towards the supporting base 20, the switch shelter 30 is blocked at a position that the locking protrusion 42 is biased against the blocking edge 221 of the first sidewall 22 in such a manner that the operation side 31 of the switch shelter 30 is pressed to drive the locking protrusion 42 slidably passing the blocking edge 221 to engage with the locking groove 41 while the contacting side 32 of the switch shelter 30 is simultaneously driven for pivotally pressing the switch member 12 downward to switch off the saw machine.

As shown in FIG. 3, when the locking protrusion 42 is blocked by the blocking edge 221 of the supporting base 20 at the operation position, the contacting side 32 of the switch shelter 30 is contacted with the switch member 12 such that a substantial pressing force must be applied by the user to depress the switch shelter 30 downwardly to pivotally drive the switch member 12 downward so as to engage the locking protrusion 42 with the locking groove 41. In other words, the folding operation of the switch shelter 30 ensures the manipulation of the switch member 12 so as to prevent an unintentional operation of the saw machine. In addition, the locking engagement between the locking groove 41 and the locking protrusion 42 ensures the operational movement of the switch member 12 to switch off the saw machine.

As shown in FIG. 2, the blocking edge 221 of the supporting base 20 is shaped to form a curve notching corner 222 to communicate with the sheltering cavity 301 for operating with the switch member 12. Accordingly, the notching corner 222 of the supporting base 20 is arranged to guide the user's thumb to pivotally move the switch member 12 to switch on the saw machine. When the user's thumb applies an upward folding force against the switch shelter 30 to unlock the switch shelter 30 from the supporting base 20 by slidably disengaging the locking protrusion 42 with the locking groove 41, the user's thumb is guided to bias against the notching corner 22 to push the switch member 12 upwardly so as to switch on the saw machine. In other words, the notching corner 222 functions as an operation guider for the user so as to ensure the intentional operation of the saw machine.

It is worth to mention that when the switch member 12 is upwardly pushed to switch on the saw machine, the switch shelter 30 is capable of pivotally folding back to the operation position that the contacting side 32 of the switch shelter 30 is contacted with the switch member 12 while the locking protrusion 42 is biased against the blocking edge 221 of the supporting base 20. Therefore, the switch member 12 is protected within the sheltering cavity 301 by the switch shelter 30 so as to prevent the sawdust or dirt entering into the control switch 10 during the cutting operation of the saw machine.

Moreover, the user is able to switch off the saw machine anytime by applying the depressing force on the operating side 31 of the switch shelter 30 to press down the switch member 12. Since the user's thumb does not directly contact with the switch member 12, which is protected within the sheltering cavity 301 by the switch shelter 30, in order to switch off the saw machine, the safety switch box of the present invention can prevent the electric shock from the saw machine especially when the user's hands are wet during the cutting operation of the saw machine.

In addition, the safety switch box of the present invention is capable of installing into any kind of saw machine having the switch member 12. As shown in FIG. 2, the installation of the safety switch box is simply that by unscrewing the switch member 12 from the switch platform 11 to locate the supporting base 20 on the switch platform 11. Then, the switch member 12 is arranged to screw back on the switch platform 11 through the through slot 201 of the supporting base 20 such that the supporting base 20 is securely mounted on the switch platform 11. In other words, the base platform 21 of the supporting base 20 is securely mounted on the switch platform 11 to retain the switch shelter 30 in position.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A safety switch box for a control switch of a saw machine which comprises a switch platform and a switch member pivotally extended thereon to operate said saw machine in an on and off manner, wherein said safety switch box comprises:

a supporting base adapted for resting on said switch platform, wherein said supporting base has a through slot formed thereon for said switch member passing through;

a switch shelter, which has an outer operating side and an inner contacting side, pivotally connected to said supporting base to define a sheltering cavity between said switch shelter and said supporting base for receiving said switch member, wherein said switch shelter is capable of being pivotally folded between an idle position and an operation position, wherein said supporting base, having a U-shaped cross section, further has a base platform defining said through slot thereon and first and second sidewalls upwardly extended from said base platform to define said sheltering cavity within said base platform, and said first and second sidewalls for retaining said switch member within said sheltering cavity, wherein said switch shelter, having a L-shaped cross section is pivotally connected to said supporting base, wherein said switch shelter further has a side arm downwardly extended from a peripheral edge to overlap with said first sidewall of said supporting base; and means for locking said switch shelter on said supporting base at said idle position, wherein at said operation position, said switch shelter is pivotally folded to a position that said contacting side of said switch shelter is adapted for contacting with said switch member to protectively shelter said switch member within said sheltering cavity in position while said saw machine is operating, and at said idle position, said operation side of said switch shelter is pressed to force said contacting side thereof for pivotally pressing said switch member downward to switch off said saw machine, wherein said locking means has a locking groove formed on said first sidewalls of said supporting base and at least a corresponding locking protrusion formed on said side arm to engage with said locking groove so as to lock up said switch shelter with said supporting base at said idle position.

2. The safety switch box, as recited in claim 1, wherein a peripheral edge of said first sidewall functions as a blocking edge to block said locking protrusion engaging with said locking groove, wherein when said switch shelter is pivotally folded towards said supporting base, said switch shelter is blocked at a position that said locking protrusion is biased against said blocking edge of said first sidewall in such a manner that said operation side of said switch shelter must be pressed to drive said locking protrusion slidably passing said blocking edge to engage with said locking groove while said contacting side of said switch shelter is simultaneously driven for pivotally pressing said switch member downward to switch off said saw machine.

3. The safety switch box, as recited in claim 2, wherein said blocking edge of said supporting base is shaped to form a curve notching corner to communicate with said sheltering cavity for operating with said switch member.

4. The safety switch box, as recited in claim 3, wherein said switch shelter further has a thumb cavity formed thereon to form said operating side of said switch shelter having a concave surface and said contacting side of said switch shelter having a corresponding convex surface.

5. The safety switch box, as recited in claim 4, wherein said contacting side of said switch shelter has a slanted surface portion arranged for contacting with said switch member so as to substantially push said switch member to switch on said saw machine.

6. The safety switch box, as recited in claim 3, wherein said contacting side of said switch shelter has a slanted surface portion arranged for contacting with said switch member so as to substantially push said switch member to switch on said saw machine.

7. The safety switch box, as recited in claim 2, wherein said switch shelter further has a thumb cavity formed thereon to form said operating side of said switch shelter having a concave surface and said contacting side of said switch shelter having a corresponding convex surface.

8. The safety switch box, as recited in claim 1, wherein said switch shelter further has a thumb cavity formed thereon to form said operating side of said switch shelter having a concave surface and said contacting side of said switch shelter having a corresponding convex surface.

9. The safety switch box, as recited in claim 1, wherein said contacting side of said switch shelter has a slanted surface portion arranged for contacting with said switch member so as to substantially push said switch member to switch on said saw machine.

10. A saw machine, comprising:

a saw blade;

a control switch electrically connected with a motor to drive said saw blade to rotate, wherein said control switch comprises a switch platform and a switch member pivotally extended thereon to operate said motor in an on and off manner; and a safety switch box, comprising:

a supporting base supported on said switch platform, wherein said supporting base has a through slot formed thereon for said switch member passing through;

a switch shelter, which has an outer operating side and an inner contacting side, pivotally connected to said supporting base to define a sheltering cavity between said switch shelter and said supporting base for receiving said switch member, wherein said switch shelter is capable of being pivotally folded between an idle position and an operation position, wherein said supporting base, having a U-shaped cross section, further has a base platform defining said through slot thereon and first and second sidewalls upwardly extended from said base platform to define said sheltering cavity within said base platform, and said first and second sidewalls for retaining said switch member within said sheltering cavity, wherein said switch shelter, having a L-shaped cross section is pivotally connected to said supporting base, wherein said switch shelter further has a side arm downwardly extended from a peripheral edge to overlap with said first sidewall of said supporting base; and means for locking said switch shelter on said supporting base at said idle position, wherein at said operation position, said switch shelter is pivotally folded to a position that said contacting side of said switch shelter is adapted for contacting with said switch member to protectively shelter said switch member within said sheltering cavity in position while said saw machine is operating, and at said idle position, said operation side of said switch shelter is pressed to force said contacting side thereof for pivotally pressing said switch member downward to switch off said saw machine, wherein said locking means has a locking groove formed on said first sidewalls of said supporting base and at least a corresponding locking protrusion formed on said side arm to engage with said locking groove so as to lock up said switch shelter with said supporting base at said idle position.

11. The saw machine, as recited in claim 10, wherein a peripheral edge of said first sidewall functions as a blocking edge to block said locking protrusion engaging with said locking groove, wherein when said switch shelter is pivotally folded towards said supporting base, said switch shelter is blocked at a position that said locking protrusion is biased against said blocking edge of said first sidewall in such a manner that said operation side of said switch shelter must be pressed to drive said locking protrusion slidably passing said blocking edge to engage with said locking groove while said contacting side of said switch shelter is simultaneously driven for pivotally pressing said switch member downward to switch off said saw machine.

12. The saw machine, as recited in claim 11, wherein said blocking edge of said supporting base is shaped to form a curve notching corner to communicate with said sheltering cavity for operating with said switch member.

13. The saw machine, as recited in claim 12, wherein said switch shelter further has a thumb cavity formed thereon to form said operating side of said switch shelter having a concave surface and said contacting side of said switch shelter having a corresponding convex surface.

14. The saw machine, as recited in claim 13, wherein said contacting side of said switch shelter has a slanted surface portion arranged for contacting with said switch member so as to substantially push said switch member to switch on said saw machine.

15. The saw machine, as recited in claim 10, wherein said switch shelter further has a thumb cavity formed thereon to form said operating side of said switch shelter having a concave surface and said contacting side of said switch shelter having a corresponding convex surface.

16. The saw machine, as recited in claim 10, wherein said contacting side of said switch shelter has a slanted surface portion arranged for contacting with said switch member so as to substantially push said switch member to switch on said saw machine.

* * * * *